US011827425B2

(12) United States Patent
Berge et al.

(10) Patent No.: US 11,827,425 B2
(45) Date of Patent: Nov. 28, 2023

(54) TAMPER EVIDENT FLIP CAP

(71) Applicant: Silgan White Cap LLC, Downers Grove, IL (US)

(72) Inventors: Gary L. Berge, Crystal Lake, IL (US); Thomas P. Hennessy, Naperville, IL (US)

(73) Assignee: Silgan White Cap LLC, Downers Grove, IL (US)

( * ) Notice: Subject to any disclaimer, the term of this patent is extended or adjusted under 35 U.S.C. 154(b) by 34 days.

(21) Appl. No.: 17/550,780

(22) Filed: Dec. 14, 2021

(65) Prior Publication Data

US 2022/0106085 A1 Apr. 7, 2022

Related U.S. Application Data

(63) Continuation of application No. 16/574,698, filed on Sep. 18, 2019, now Pat. No. 11,214,414.

(51) Int. Cl.
*B65D 47/08* (2006.01)
*B65D 41/04* (2006.01)

(52) U.S. Cl.
CPC ..... *B65D 47/088* (2013.01); *B65D 41/0428* (2013.01); *B65D 2401/20* (2020.05); *B65D 2401/30* (2020.05)

(58) Field of Classification Search
CPC ..... B65D 41/04; B65D 39/08; B65D 41/32; B65D 41/34; B65D 55/06; B65D 55/024; B65D 55/02; B65D 2251/1058; B65D 2251/1016; B65D 47/088; B65D 41/0428; B65D 2401/20; B65D 2401/30; B65D 2251/04; B65D 47/0814; B65D 2401/15; B65D 47/0804
See application file for complete search history.

(56) References Cited

U.S. PATENT DOCUMENTS 4,545,496 A * 10/1985 Wilde ..... B29C 57/00 215/252
4,742,928 A 5/1988 Braun
4,744,479 A * 5/1988 Schottli ..... B65D 41/3452 215/252

(Continued)

FOREIGN PATENT DOCUMENTS

JP 2008-222249 9/2008
JP 2015-127228 7/2015

OTHER PUBLICATIONS

International Search Report and Written Opinion for PCT/US2020/039302, dated Oct. 6, 2020, 13 pages.

*Primary Examiner* — Kareen K Thomas
(74) *Attorney, Agent, or Firm* — Reinhart Boerner Van Deuren s.c.

(57) ABSTRACT

A closure includes a flip-top structure and a tamper-evident band. The flip-top structure is restricted from being opened because it interfaces against an underlying protrusion, such as a thread of a container's neck. To open the flip-top structure the closure is rotated with respect to the container neck. When the closure is rotated with respect to the container neck, the closure is configured such that the tamper-evident band breaks before the flip-top structure is permitted to rotate to an open position. Thus, the closure prevents accessing the container's contents until after the tamper-evident band is broken even with the addition of a flip-top structure.

20 Claims, 14 Drawing Sheets

(56) References Cited

U.S. PATENT DOCUMENTS 4,787,525 A * 11/1988 Joyce ..... B65D 47/0838 215/237
4,795,044 A * 1/1989 Beck ..... B65D 47/0814 215/253
4,941,580 A * 7/1990 Julian ..... B65D 41/32 215/235
5,040,691 A * 8/1991 Hayes ..... B65D 50/061 215/206
5,069,367 A * 12/1991 Salmon ..... B65D 47/0838 215/346
5,145,646 A 9/1992 Tyranski
5,201,440 A * 4/1993 Gross ..... B65D 47/0861 222/541.9
5,246,145 A 9/1993 Leoncavallo et al.
5,397,013 A * 3/1995 Adams ..... B65D 41/3409 222/541.9
5,582,314 A 12/1996 Quinn et al.
5,875,942 A * 3/1999 Ohmi ..... B65D 47/0833 222/153.07
6,003,728 A * 12/1999 Elliott ..... B65D 47/0804 222/129
6,116,441 A * 9/2000 Decelles ..... B65D 51/20 222/153.07
6,170,683 B1 1/2001 Montgomery
6,269,986 B1 * 8/2001 Gross ..... B65D 47/0804 222/153.06
6,405,885 B1 * 6/2002 Elliott ..... B65D 47/0838 222/541.9
6,550,626 B1 * 4/2003 Randall ..... B65D 41/3442 220/259.2
7,861,873 B1 1/2011 Bragg et al.
8,292,101 B1 10/2012 Bragg et al.
2002/0014501 A1 * 2/2002 Nyman ..... B65D 35/44 222/153.07
2002/0079282 A1 * 6/2002 Harrold ..... B65D 47/0809 222/153.07
2003/0034323 A1 * 2/2003 Smith ..... B65D 55/024 215/253
2003/0062369 A1 * 4/2003 Hierzer ..... B65D 47/0804 220/717
2003/0136783 A1 7/2003 Hatsumoto et al.
2006/0186079 A1 * 8/2006 Ziegenhorn ..... B65D 47/0809 222/153.07
2007/0102390 A1 * 5/2007 Hoepner ..... B65D 47/0885 222/153.07
2007/0102391 A1 * 5/2007 Hoepner ..... B65D 55/024 215/237
2007/0102392 A1 * 5/2007 Hoepner ..... B65D 55/024 215/253
2007/0235406 A1 10/2007 Young
2008/0011704 A1 * 1/2008 Van Ryn ..... B65D 55/02 215/254
2008/0035674 A1 * 2/2008 Stoneberg ..... B65D 51/185 222/153.06
2008/0073348 A1 * 3/2008 Pritikin ..... B65D 47/147 222/1
2008/0169261 A1 * 7/2008 Druitt ..... B65D 47/0809 215/253
2009/0026166 A1 * 1/2009 Druitt ..... B65D 41/045 215/316
2009/0308832 A1 * 12/2009 Von Spreckelsen ..... B65D 47/0804 215/316
2011/0108509 A1 * 5/2011 Fontana ..... B65D 55/024 215/228
2012/0111821 A1 5/2012 Starr et al.
2015/0368009 A1 12/2015 Loukov
2017/0050773 A1 2/2017 Rognard et al.

* cited by examiner

TAMPER EVIDENT FLIP CAP

CROSS-REFERENCE TO RELATED PATENT APPLICATION

This application is a continuation of U.S. application Ser. No. 16/574,698, filed Sep. 18, 2019, which is incorporated herein by reference in its entirety.

BACKGROUND OF THE INVENTION

The present disclosure relates generally to the field of closures. The present disclosure relates specifically to a flip cap closure with tamper-evidencing features.

SUMMARY OF THE INVENTION

Described herein are systems and methods to for implementing a flip top tamper-evidencing closure. In one embodiment a container includes a container body, a container neck coupled to the container neck, and a closure affixed to the container neck. The container neck is centered around a longitudinal axis and the closure and container neck are coupled via interfacing helical threads. The closure includes an annular sidewall, which has the helical thread, a top structure pivotally coupled to the annular sidewall, a content enclosure fixedly coupled to the annular sidewall, and a tamper-evident band. The top structure includes an annular wall, a securing tongue, and a safety tongue. The safety tongue restricts pivotal rotation of the top structure with respect to the annular sidewall, and the top structure pivotally rotates with respect to the annular sidewall via a hinge that is opposed to the securing tongue with respect to the longitudinal axis. The content enclosure includes an interior wall, which defines an aperture, a lip, a bottom surface, and an annular wall protruding from the bottom surface. The content enclosure's annular wall interfaces with the container neck to form a fluid-tight seal, and the content enclosure's interior wall interfaces with the top structure's annular wall to form a fluid-tight seal. The top structure and the content enclosure collectively form a fluid-tight seal. The tamper-evident band is coupled to the annular sidewall via a plurality of frangible connections. The safety lock restricts pivotal rotation of the top structure with respect to the annular sidewall when the plurality of frangible connections are unbroken.

In another embodiment, a closure includes an annular sidewall centered around the longitudinal axis, a content enclosure, a top structure, and a tamper-evident band. The content enclosure includes a lip and is fixedly coupled to the annular sidewall. The top structure is pivotally coupled to the content enclosure, and the top structure includes an annular wall that interfaces with the content enclosure to form a fluid-tight seal. The top structure further includes a securing latch that interfaces with the content enclosure's lip, and a safety lock that restricts pivotal rotation of the top structure with respect to the content enclosure. The top structure is pivotally coupled to the content enclosure via a hinge that is opposed to the securing latch with respect to the longitudinal axis.

In another embodiment, the closure includes an annular sidewall centered around a longitudinal axis, a top structure, a content enclosure fixedly coupled to the annular sidewall, a tamper-evident band, and a stop coupled to the tamper band. The top structure is pivotally coupled to the annular sidewall. The top structure includes a safety tongue that inhibits pivotal rotation of the top structure with respect to the annular sidewall. The top structure pivotally rotates with respect to the annular sidewall via a hinge that is opposed to the safety tongue with respect to the longitudinal axis. The content enclosure defines an aperture that interfaces with the top structure's annular wall to form a fluid-tight seal. The stop is coupled to the tamper band to inhibit rotation of the closure when the annular sidewall is rotated.

Additional features and advantages will be set forth in the detailed description which follows, and, in part, will be readily apparent to those skilled in the art from the description or recognized by practicing the embodiments as described in the written description and claims hereof, as well as the appended drawings. It is to be understood that both the foregoing general description and the following detailed description are exemplar

BRIEF DESCRIPTION OF THE DRAWINGS

This application may be more fully understood from the following detailed description, taken in conjunction with the accompanying figures, wherein like reference numerals refer to like elements in which.

DETAILED DESCRIPTION

Many closures for containers include tamper-evidencing bands that indicate when the seal between the closure and the container has been opened. Many other closures include flip-top structures that allow users to easily toggle the closure between an open and closed position. However, the flip-top structure and the tamper-evidencing band generally operate independently of each other.

In one embodiment, a closure includes a flip-top structure that is prevented from being opened by interfacing against an underlying protrusion (e.g., a thread of a container neck). The flip-top structure is prevented from opening until the closure is rotated with respect to the container neck. When the closure is rotated with respect to the container neck, the tamper-evident band breaks before the flip-top structure is permitted to open. Thus, the closure prevents accessing the container's contents until after the tamper-evident band is broken.

Figure 1:
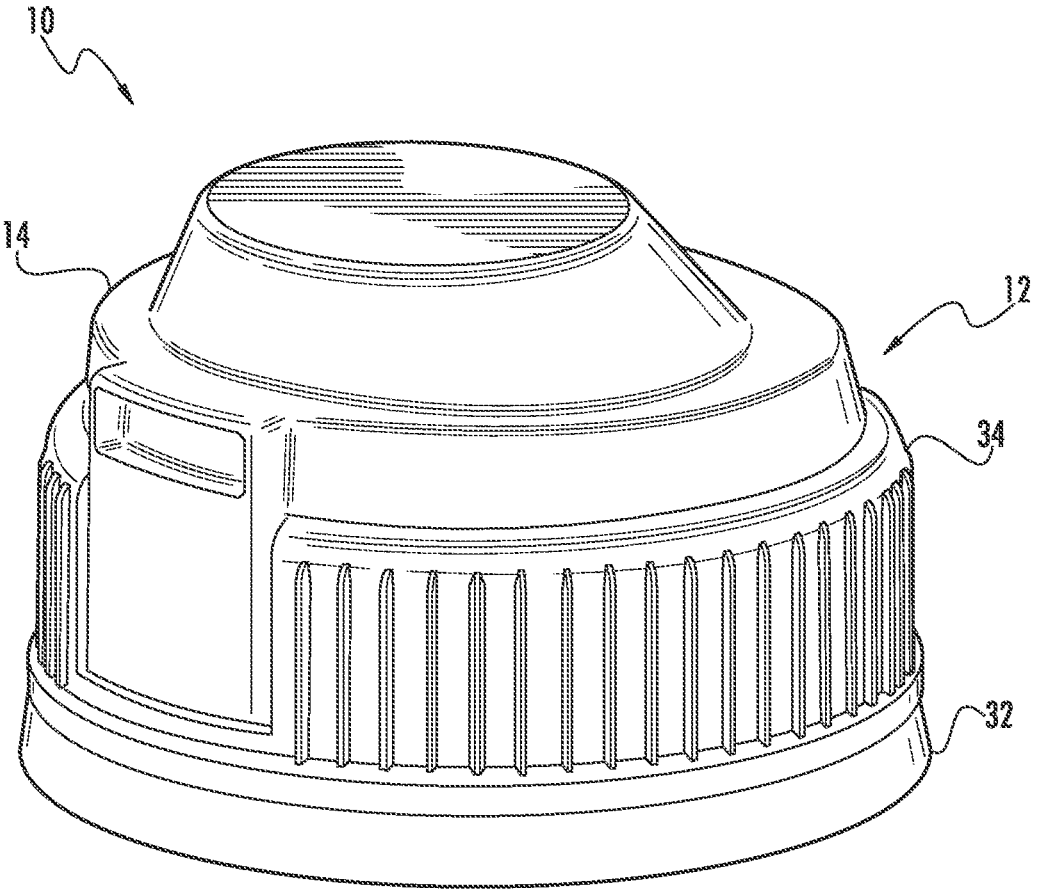
FIG. 1 depicts a perspective view of a tamper-evidencing flip top closure, according to an exemplary embodiment.
Figure 2:
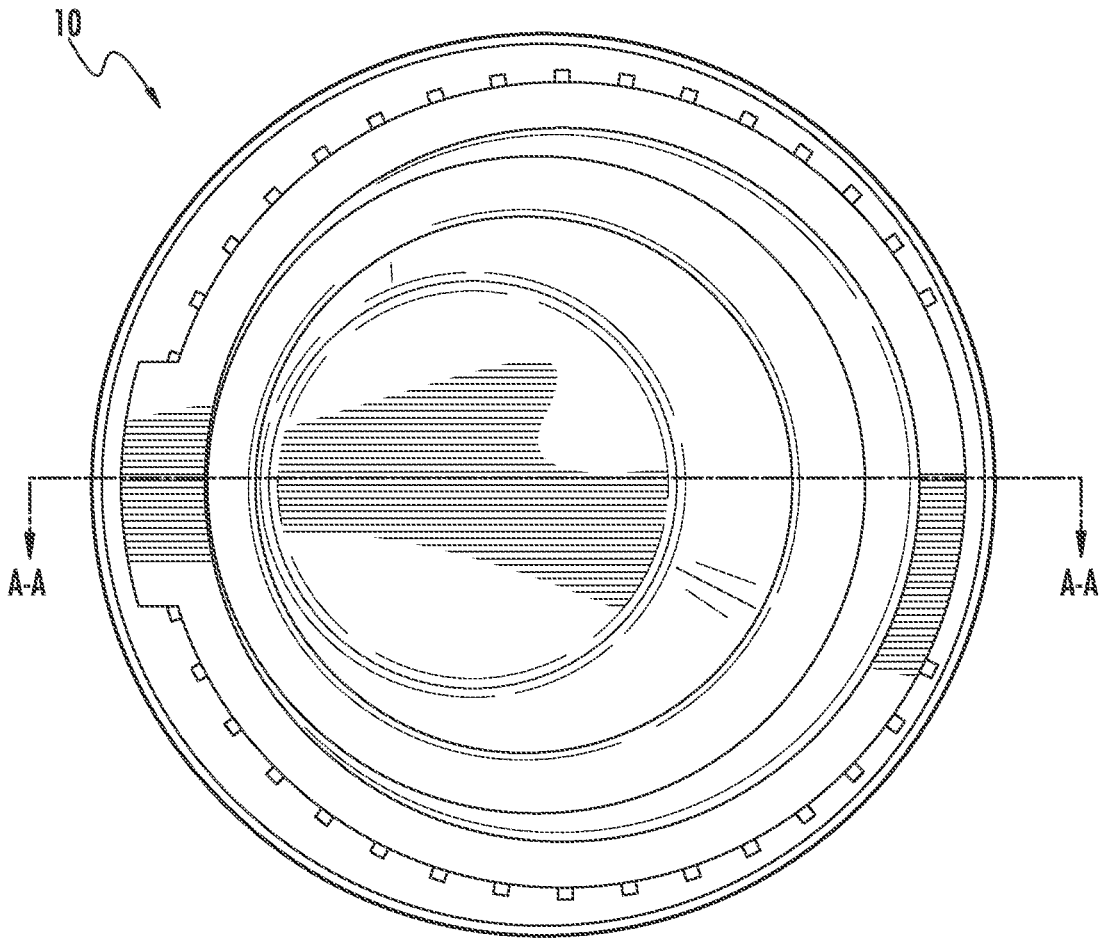
FIG. 2 depicts a top view of a tamper-evidencing flip top closure, according to an exemplary embodiment.
Figure 3:
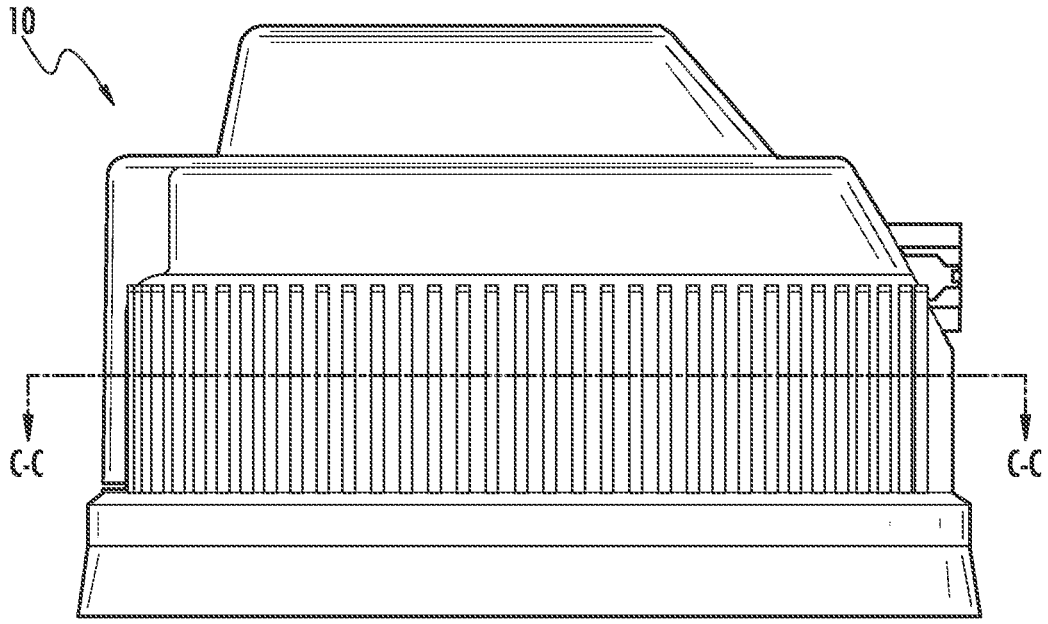
FIG. 3 depicts a side view of a tamper-evidencing flip top closure, according to an exemplary embodiment.
Figure 4:
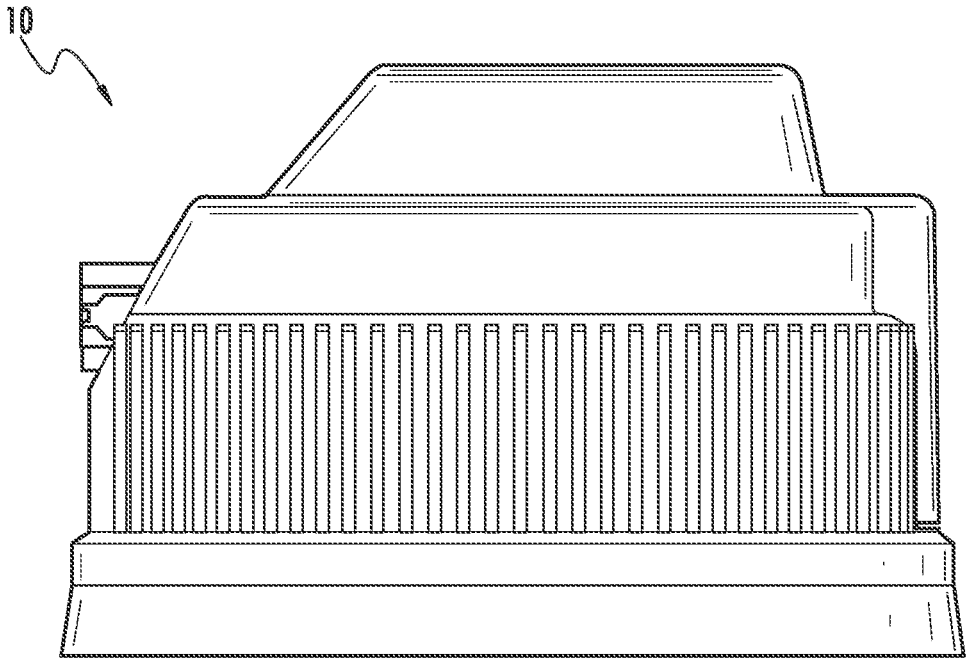
FIG. 4 depicts a side view of a tamper-evidencing flip top closure, according to an exemplary embodiment.
Figure 5:
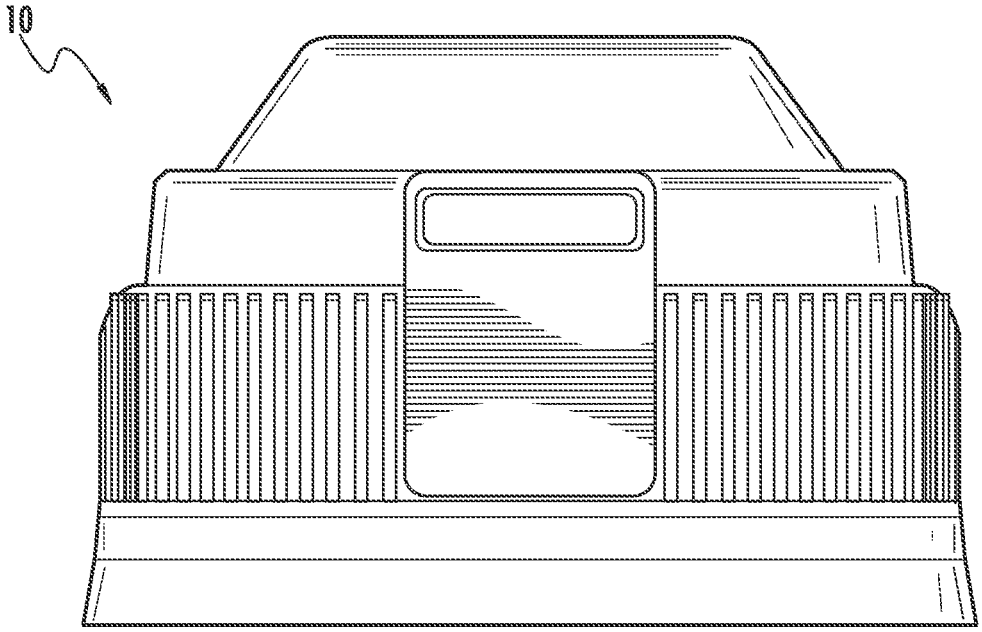
FIG. 5 depicts a front view of a tamper-evidencing flip top closure, according to an exemplary embodiment.
Figure 6:
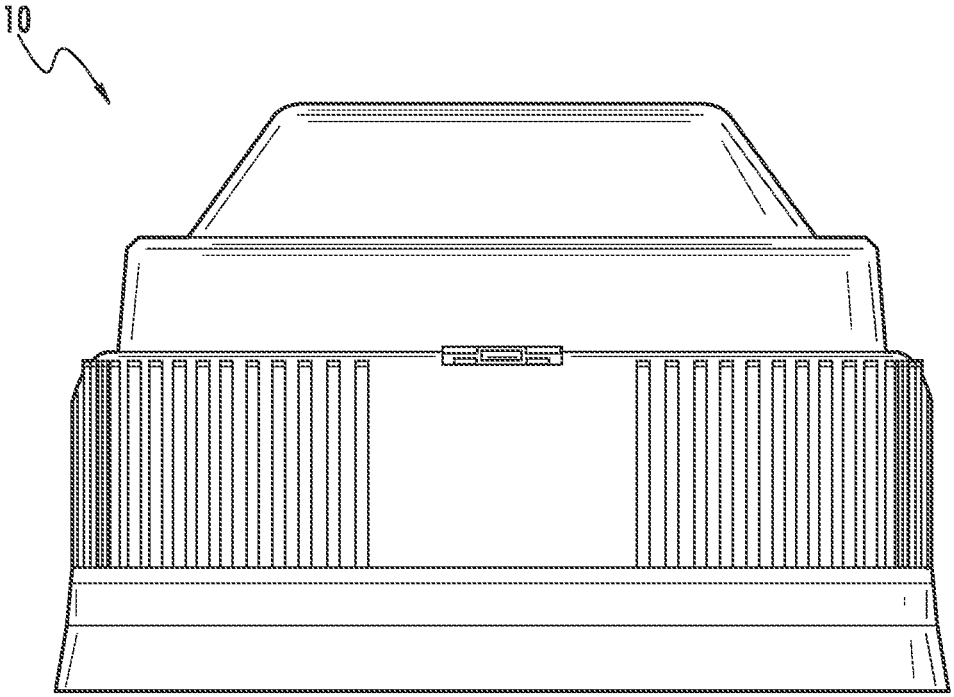
FIG. 6 depicts a back view of a tamper-evidencing flip top closure, according to an exemplary embodiment.
Figure 7:
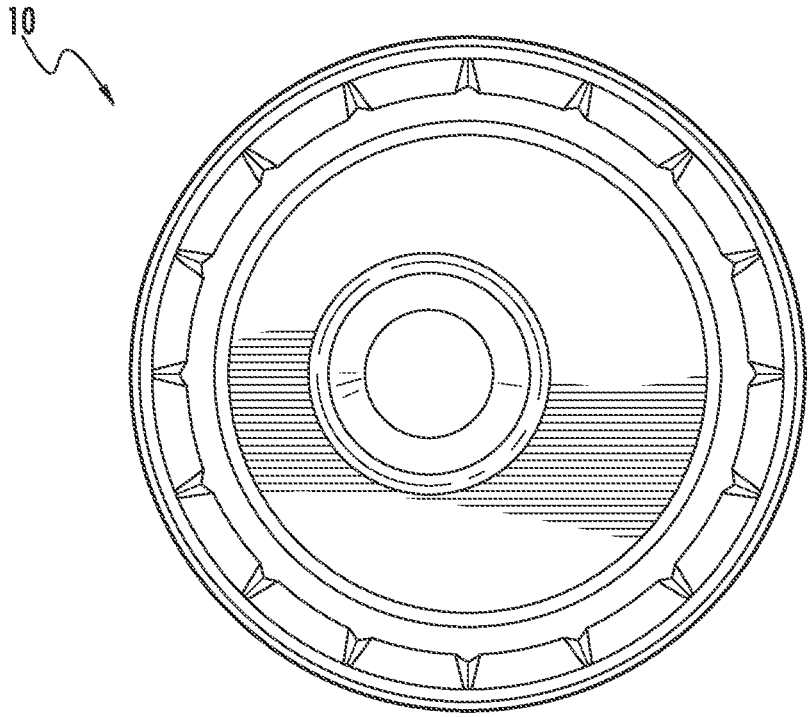
FIG. 7 depicts a bottom view of a tamper-evidencing flip top closure, according to an exemplary embodiment.

Illustrated in FIG. 1 is an exemplary flip-top closure 10. Flip-top closure 10 comprises top structure 14 that rotates with respect to content enclosure 34 via hinge 12, which is located at the back of flip-top closure 10 from the perspective of FIG. 1. FIGS. 2-7 illustrate various orthogonal views of flip-top closure 10.

Figure 8:
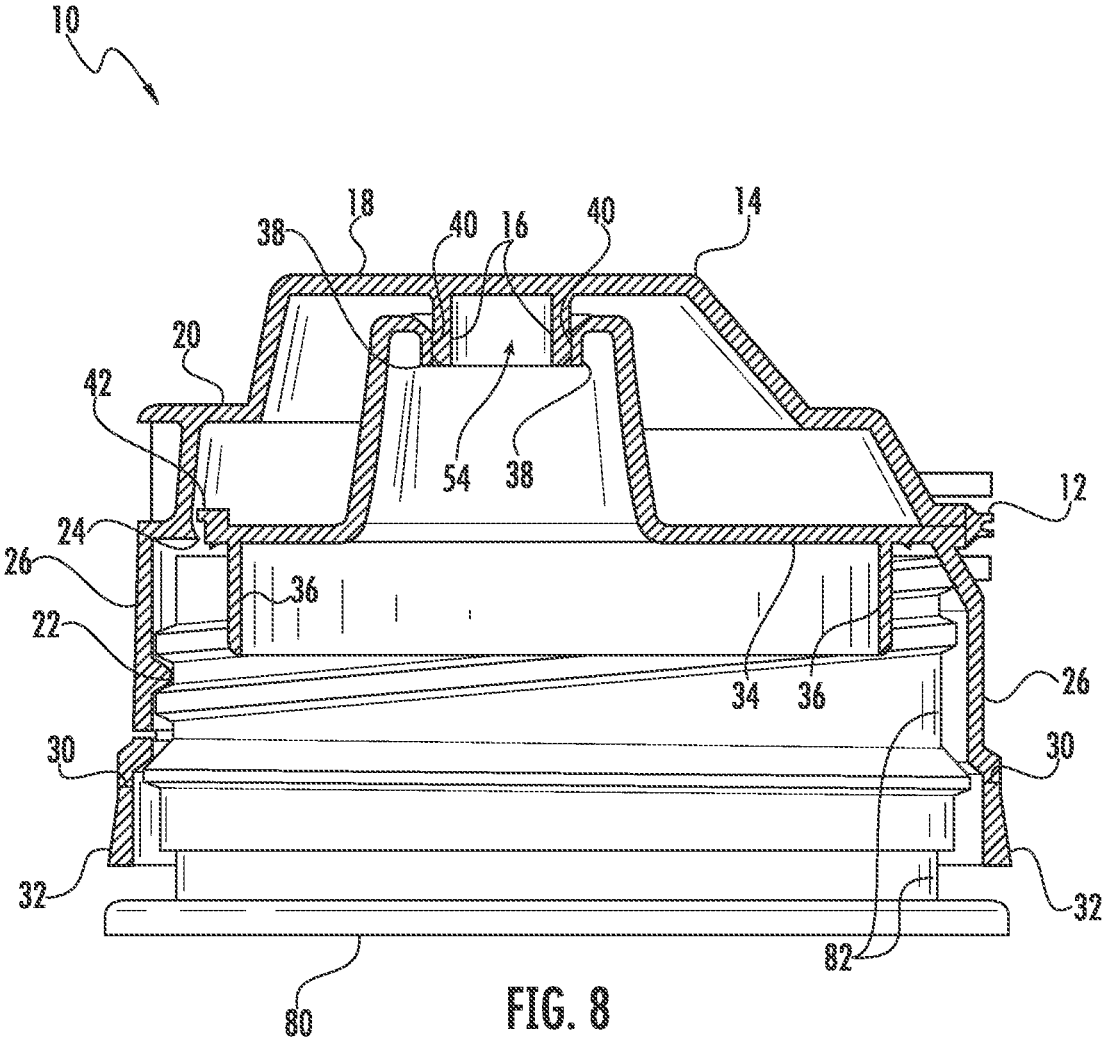
FIG. 8 is a cross-sectional side view of a tamper-evidencing flip top closure taken along the plane A-A defined in FIG. 2, according to an exemplary embodiment.
Figure 9:
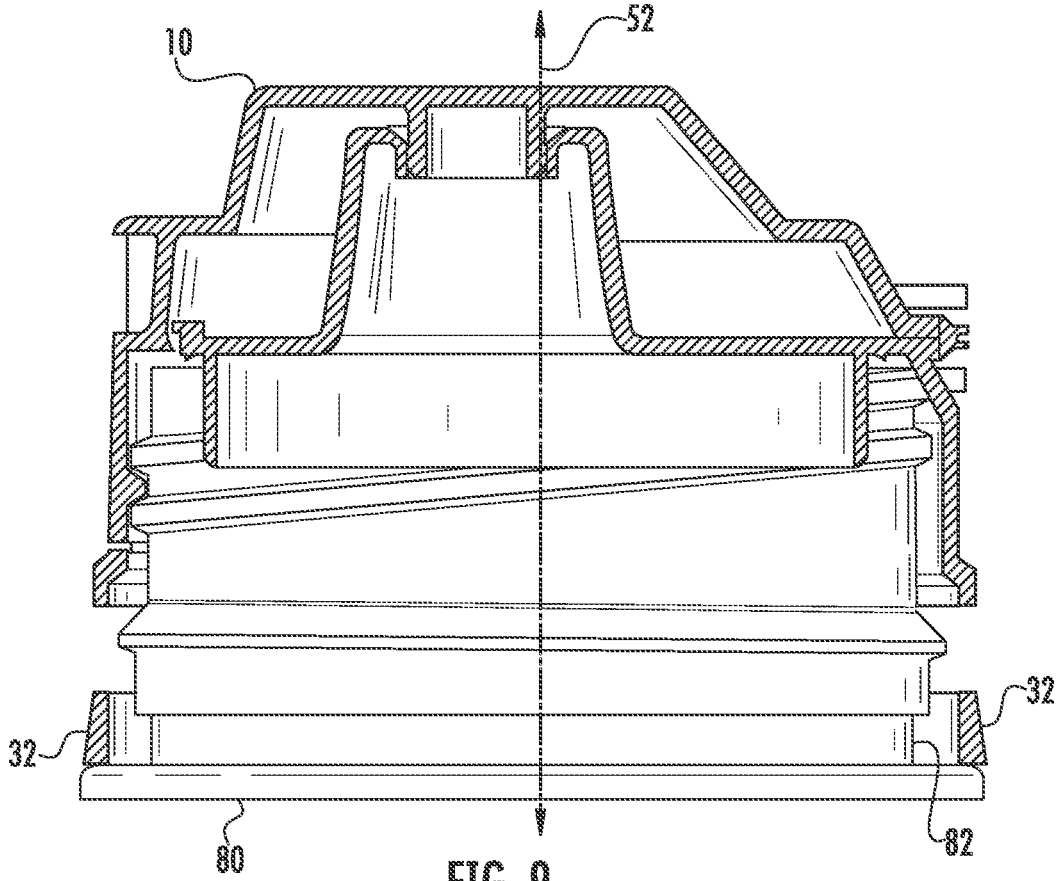
FIG. 9 is a cross-sectional side view of a tamper-evidencing flip top closure taken along the plane A-A defined in FIG. 2, according to an exemplary embodiment.

Turning to FIGS. 8-9, illustrated therein is a cross-sectional view of flip-top closure 10. Annular sidewall 26 comprise threads 28 and are affixed to container neck 82 of container 80. Annular sidewall 26 of closure 10 is centered on longitudinal axis 52. Annular sidewall 36 of content enclosure 34 interfaces against container neck 82 to almost entirely seal aperture 102 of container neck 82, except for aperture 54 of content enclosure 34. To seal aperture 54, top structure 14 comprises annular channel 16 that interfaces with neck 38 of content enclosure 34. Annular channel 16 and planar top wall 18 of top structure 14 collectively form a liquid-seal around aperture 54 of content enclosure 34 to seal contents of container 80 within body 100 of container 80.

Top structure 14 pivotally rotates around hinge 12 with respect to content enclosure 34 between a closed position (shown in FIG. 8) and an open position. Top structure 14 comprises engaging structure 20, which comprises several elements that interface with other components to restrict or even prevent rotation of top structure 14 with respect to content enclosure 34. Engaging structure 20 comprises safety lock 22 and securing tongue 24. Safety lock 22 interfaces with thread 84 to prevent top structure 14 from rotating towards an open position. Securing tongue 24 interfaces with lip 42 to restrict top structure 14 rotating towards an open position.

Flip-top closure 10 comprises tamper-evident band 32, which is coupled to annular sidewalls 26 via frangible connections 30. Tamper-evident band 32 comprises J-band 50, which extends inwardly and upwardly, from the perspective of FIG. 9. When flip-top closure 10 is rotated with respect to container neck 82, J-band 50 interfaces against container neck 82 until frangible connections 30 are broken, thus de-coupling tamper-evident band 32 from annular sidewall 26.

Figure 10:
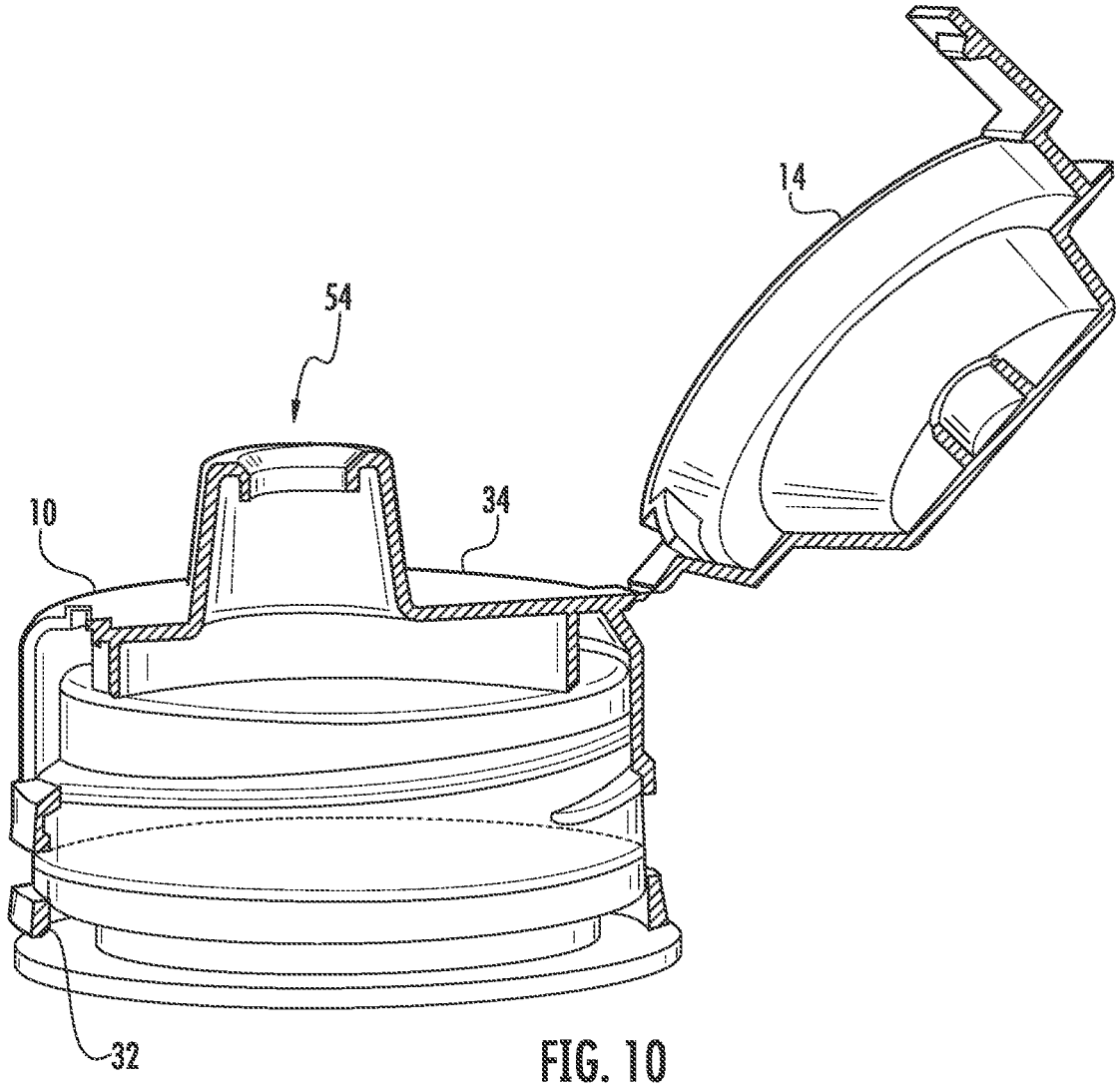
FIG. 10 is a cross-sectional side view of an open tamper-evidencing flip top closure taken along the plane A-A defined in FIG. 2, the closure being affixed to a container neck, according to an exemplary embodiment.
Figure 11:
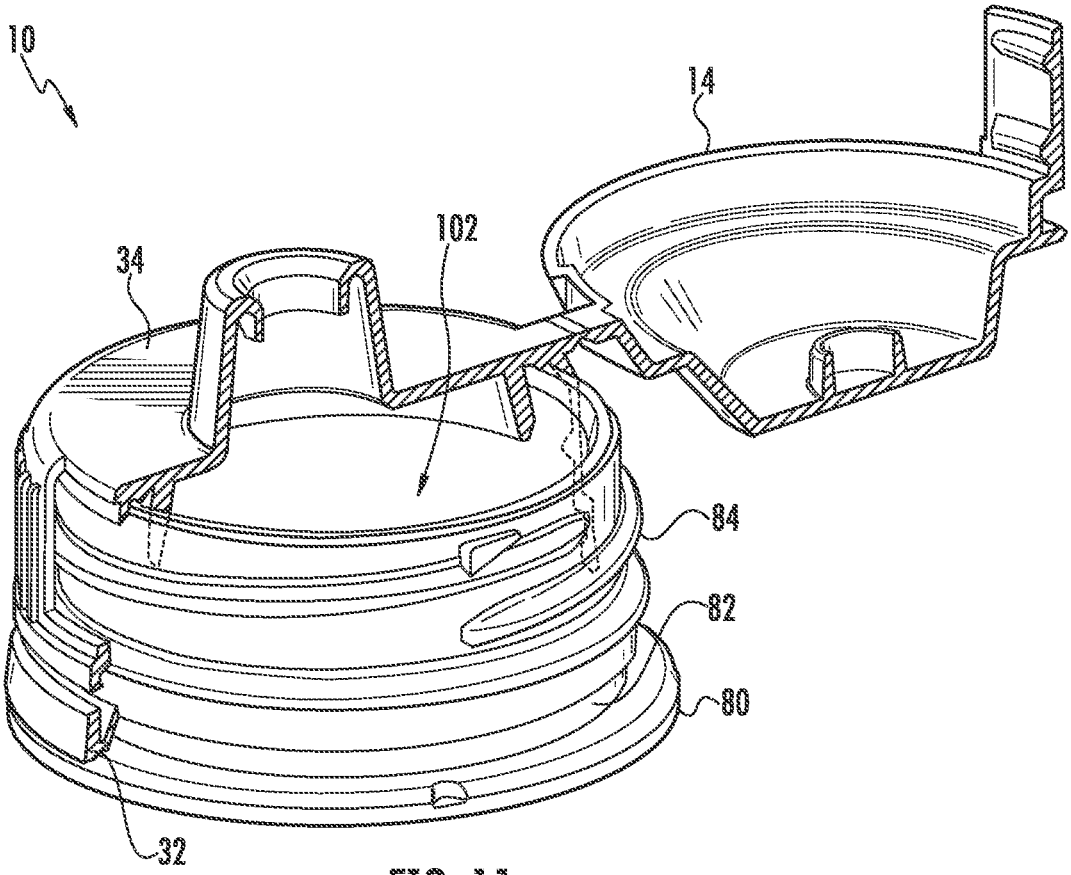
FIG. 11 is a cross-sectional side view of an open tamper-evidencing flip top closure taken along the plane A-A defined in FIG. 2, the closure being affixed to a container neck, according to an exemplary embodiment.

For example, turning to FIGS. 9-11, when flip-top closure 10 is rotated with respect to container neck 82 then threads 28 of closure 10 sidewall 26 interface against thread 84 of container neck 82, forcing flip-top closure 10 up. J-band 50 interfaces with locking protrusion 98 until frangible connections 30 break, thus de-coupling tamper-evident band 32 from sidewalls 26. Subsequently, safety lock 22 no longer interfaces with threads 84 (best shown FIG. 10), thus allowing top structure 14 to pivotally rotate with respect to content enclosure 34. As a result, contents of container 80 are permitted to selectively exit container 80 via aperture 54 of content enclosure 34. Subsequently, flip-top closure 10 can be selectively rotated with respect to container neck 82 to a position in which safety lock 22 interfaces with thread 84, restricting the rotation of top structure 14 to a closed position.

When being opened, thread(s) 28 of closure 10 interface against thread(s) 84 of container 80. Vertical distance 92 between thread(s) 84 of container 80 in part determines the amount of play that closure 10 has when being rotated with respect to container 80.

Figure 12:
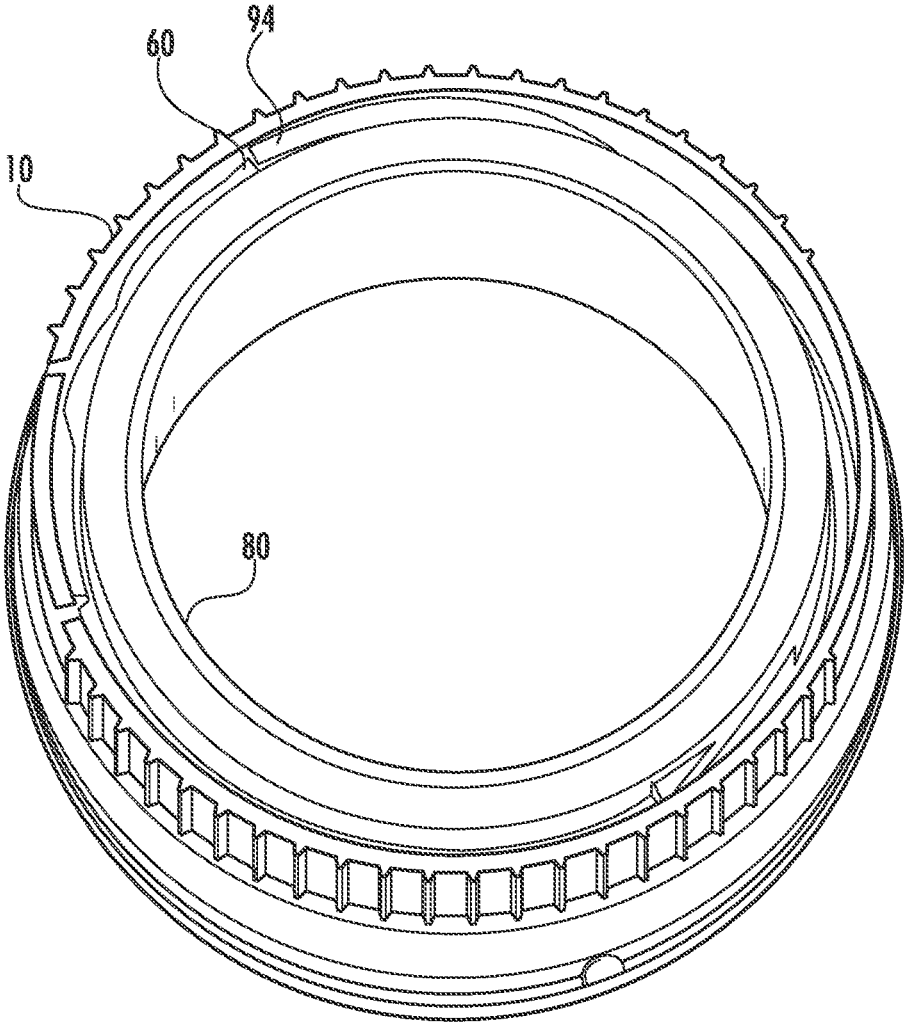
FIG. 12 is a cross-sectional perspective view of a closure and container taken along the plane C-C defined in FIG. 3, the closure being affixed to a container neck, according to an exemplary embodiment.
Figure 13:
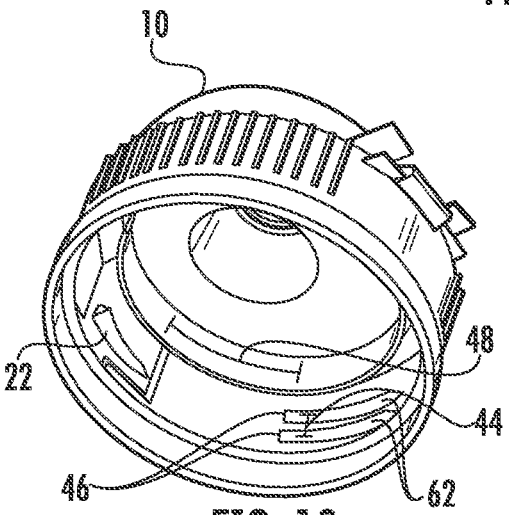
FIG. 13 depicts a perspective bottom view of a tamper-evidencing flip top closure, according to an exemplary embodiment.
Figure 14:
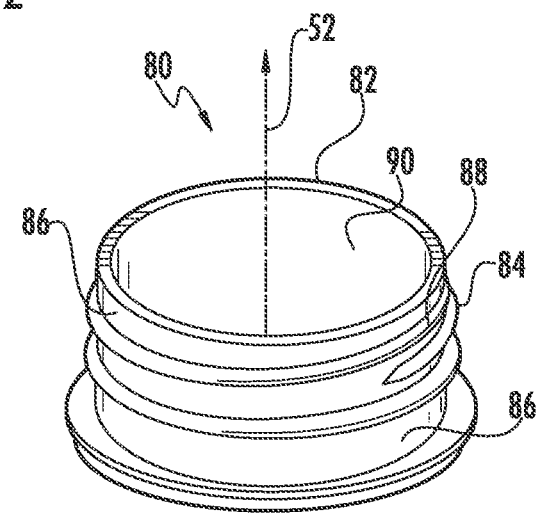
FIG. 14 depicts a perspective top view of a container neck, according to an exemplary embodiment.

FIG. 12 is a cross-sectional perspective view of a flip-top closure 10 affixed to container 80. Container 80 comprises stops 94 that interface with stop 60 affixed to flip-top closure 10, thereby preventing the full-removal of flip-top closure 10 from container neck 82. FIG. 13 illustrates the fragmented nature of threads 28, according to an embodiment. Thread 28 comprises thread segments 62, which are separated by vertical gaps 44 and helical gaps 48. Thread segments 62 are delimited by ends 46. FIG. 14 illustrates container 80 with container neck 82. Threads 84 protrude from outer surface 86 radially away from longitudinal axis 52. Inner surface 90 of container neck 82 faces inwardly towards longitudinal axis 52.

Figure 15:
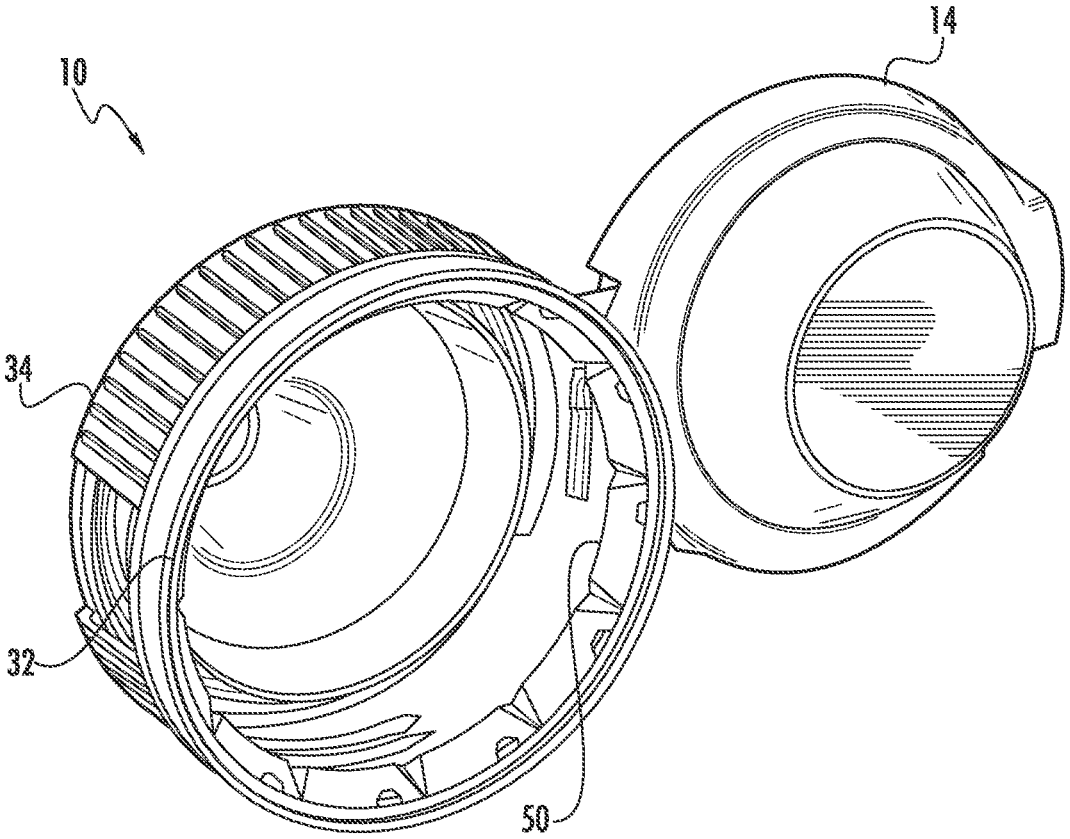
FIG. 15 depicts a perspective bottom view of a tamper-evidencing flip top closure, according to an exemplary embodiment.

FIG. 15 is a perspective view of a closure according to an embodiment described herein. Among other features, the view depicted in FIG. 15 illustrates the alternating nature of the threads 28 such that thread 28 does not protrude across all 360 degrees of closure 10. In alternate embodiments thread 28 does protrude across all 360 degrees of closure 10.

Figure 16:
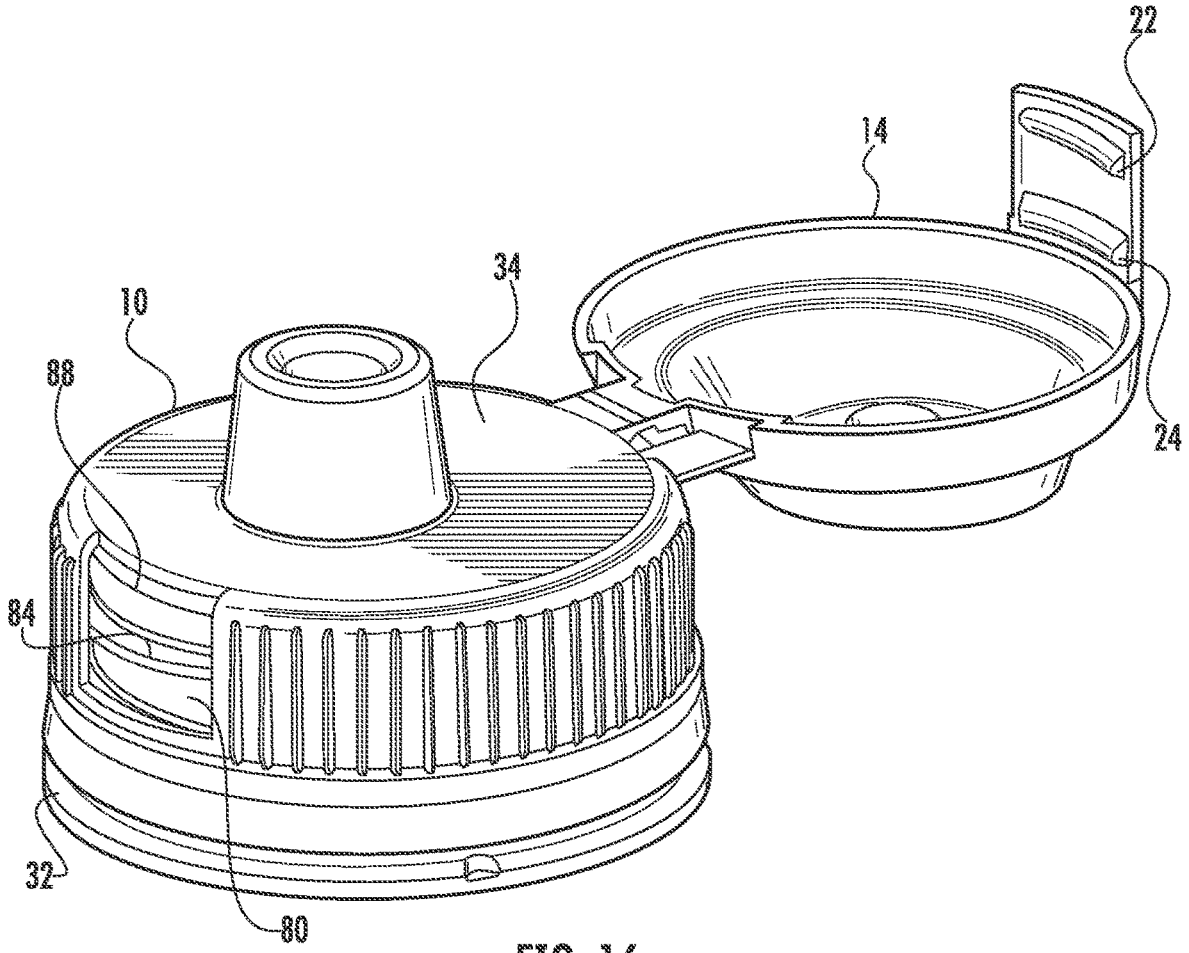
FIG. 16 depicts a perspective top view of a tamper-evidencing flip top closure in an open position, the closure affixed to a container neck, according to an exemplary embodiment.
Figure 17:
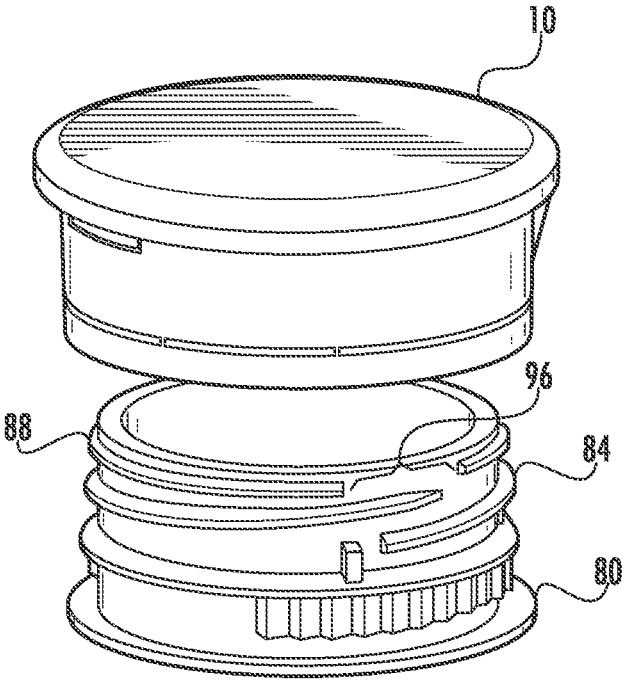
FIG. 17 is a perspective view of a tamper-evidencing flip top closure and a container neck, according to an exemplary embodiment.
Figure 18:
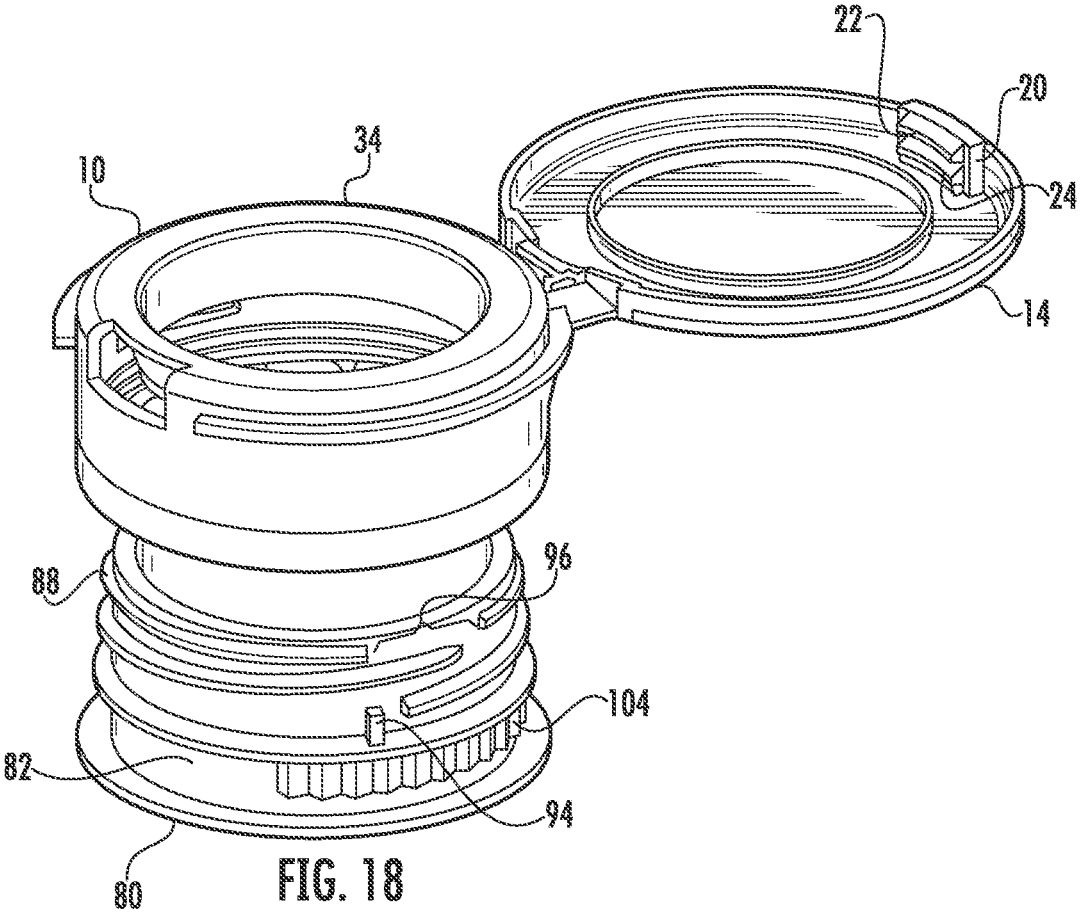
FIG. 18 is a perspective view of an open tamper-evidencing flip top closure and a container neck, according to an exemplary embodiment.
Figure 19:
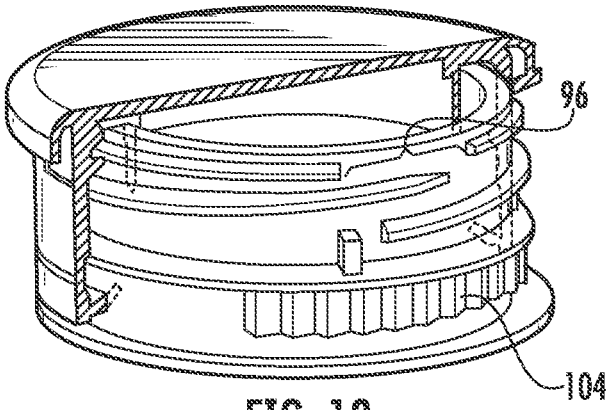
FIG. 19 is a perspective cross-sectional view of a tamper-evidencing flip top closure affixed to a container neck, according to an exemplary embodiment.
Figure 20:
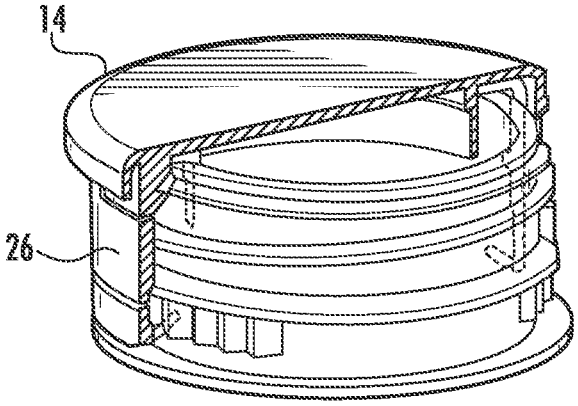
FIG. 20 is a perspective cross-sectional view of a tamper-evidencing flip top closure affixed to a container neck, according to an exemplary embodiment.
Figure 21:
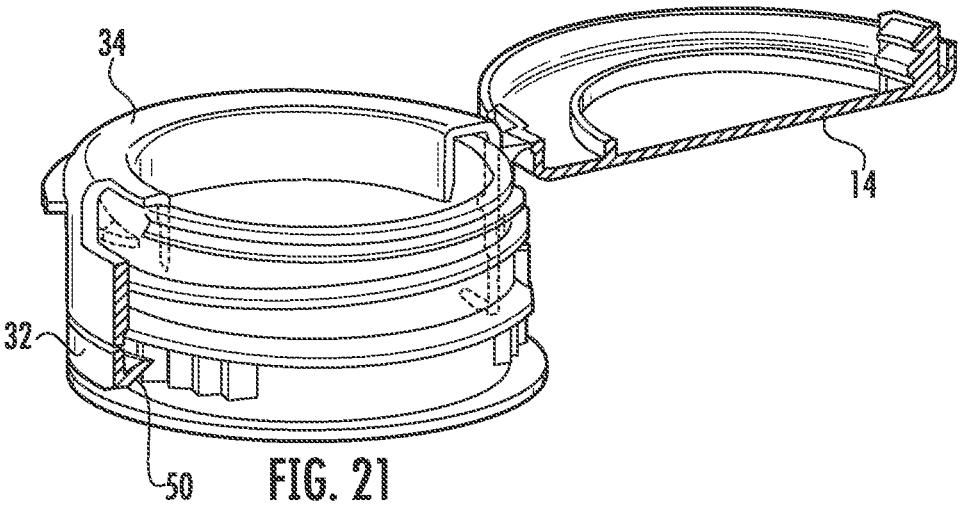
FIG. 21 is a perspective cross-sectional view of an open tamper-evidencing flip top closure affixed to a container neck, according to an exemplary embodiment.
Figure 22:
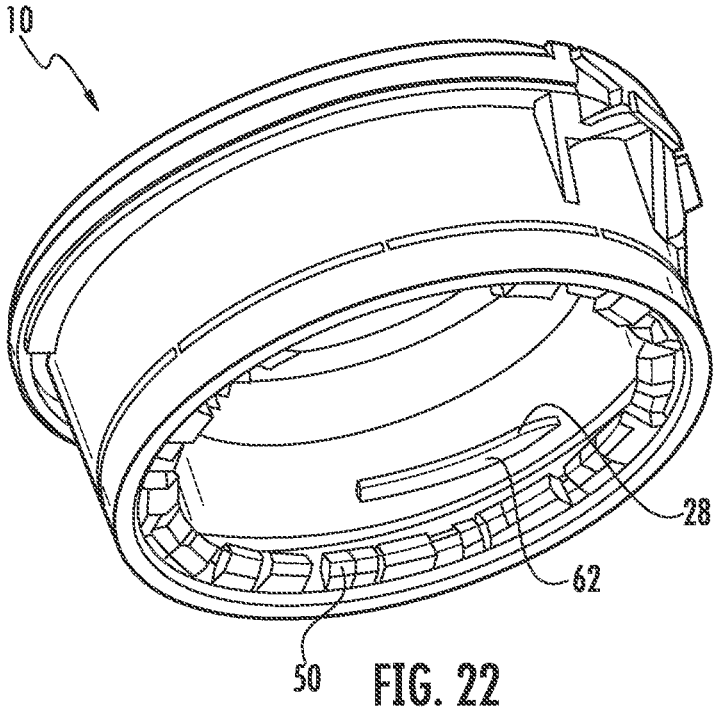
FIG. 22 is a perspective bottom view of a tamper-evidencing flip top closure, according to an exemplary embodiment.
Figure 23:
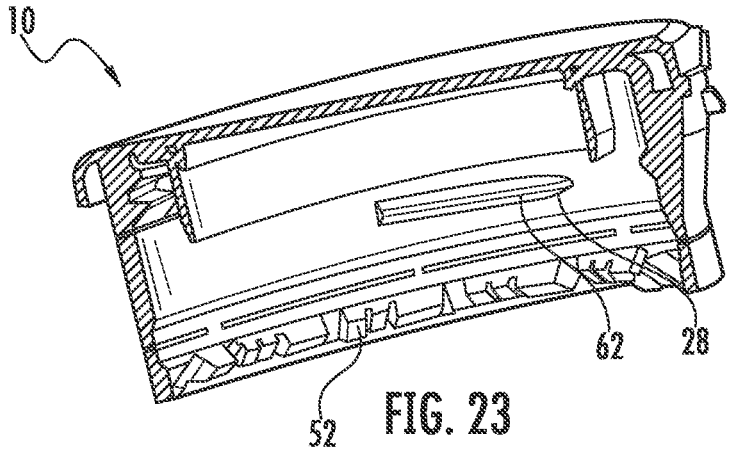
FIG. 23 is a cross-sectional view of a tamper-evidencing flip top closure affixed to a container neck, according to an exemplary embodiment.

FIG. 16 depicts closure 10 attached to container such that top structure 14 has been rotated open and subsequently closure 10 was rotated with respect to container neck 82. As a result, thread 84 will interfere with top structure 14 rotating back in to the closed position against container neck 82. One solution to this is to rotate closure 10 again so that thread 84 no longer interferes with top structure 14 being rotated into the closed position.

Turning to FIGS. 17-23, illustrated therein is an alternate embodiment of flip-top closure 10. In this alternate embodiment, J-band 50 rotationally interfaces against ratchet lock 104 to cause the breakage of frangible connections 30.

J-band 50 of tamper-evident band 32 interfaces against ratchet lock 104 on container neck 82. As a result of that interfacing, when flip-top closure 10 is rotated with respect to container neck 82, frangible connections 30 are broken when flip-top closure 10 is rotated. Subsequently, flip-top closure 10 is rotated to a position win which safety lock 22 is aligned with lock recess 96, thus allowing top structure 14 to pivot with respect to annular sidewalls 26.

It should be understood that the figures illustrate the exemplary embodiments in detail, and it should be understood that the present application is not limited to the details or methodology set forth in the description or illustrated in the figures. It should also be understood that the terminology is for the purpose of description only and should not be regarded as limiting.

Further modifications and alternative embodiments of various aspects of the disclosure will be apparent to those skilled in the art in view of this description. Accordingly, this description is to be construed as illustrative only. The construction and arrangements, shown in the various exemplary embodiments, are illustrative only. Although only a few embodiments have been described in detail in this disclosure, many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. Some elements shown as integrally formed may be constructed of multiple parts or elements, the position of elements may be reversed or otherwise varied, and the nature or number of discrete elements or positions may be altered or varied. Other substitutions, modifications, changes and omissions may also be made in the design, operating conditions and arrangement of the various exemplary embodiments without departing from the scope of the present disclosure.

While the current application recites particular combinations of features in the claims appended hereto, various embodiments of the disclosure relate to any combination of any of the features described herein whether or not such combination is currently claimed, and any such combination of features may be claimed in this or future applications. Any of the features, elements, or components of any of the exemplary embodiments discussed above may be used alone or in combination with any of the features, elements, or components of any of the other embodiments discussed above.

In various exemplary embodiments, the relative dimensions, including angles, lengths and radii, as shown in the Figures are to scale. Actual measurements of the Figures will disclose relative dimensions, angles and proportions of the various exemplary embodiments. Various exemplary embodiments extend to various ranges around the absolute and relative dimensions, angles and proportions that may be determined from the Figures. Various exemplary embodiments include any combination of one or more relative dimensions or angles that may be determined from the Figures. Further, actual dimensions not expressly set out in this description can be determined by using the ratios of dimensions measured in the Figures in combination with the express dimensions set out in this description.

What is claimed is:

1. A container assembly comprising:

a container comprising:

a container body; and a container neck coupled to the container body and centered around a longitudinal axis, the container neck comprising a helical thread protruding from the container neck outwardly away from the longitudinal axis; and a closure affixed to the container neck, the closure comprising:

a first annular wall comprising a helical thread inwardly facing towards the longitudinal axis, the helical thread of the first annular wall configured to slidably engage with the helical thread of the container neck;

a top structure pivotally coupled to the first annular wall via a hinge, the top structure comprising a second annular wall and an engaging structure, the engaging structure restricts pivotal rotation of the top structure with respect to the first annular wall;

a content enclosure fixedly coupled to the first annular wall, the content enclosure comprising a third annular wall and an interior wall defining an aperture, the third annular wall interfacing with the container neck to form a fluid-tight seal, and the interior wall of the content enclosure interfacing with the top structure to form a fluid-tight seal, the top structure and the content enclosure configured to collectively form a fluid-tight seal with the container neck; and a tamper-evident band coupled to the first annular wall via a plurality of frangible connections, wherein the engaging structure restricts pivotal rotation of the top structure with respect to the first annular wall when the plurality of frangible connections are unbroken.

2. The container assembly of claim 1, the first annular wall and the third annular wall configured to engage opposing sides of the container neck.

3. The container assembly of claim 1, wherein the engaging structure restricts pivotal rotation of the top structure with respect to the first annular wall in part by interfacing against the helical thread of the container neck.

4. The container assembly of claim 3, the closure further comprising:

a J-band coupled to the tamper-evident band, wherein the J-band selectively interfaces against the container neck thereby causing the plurality of frangible connections to break.

5. The container assembly of claim 1, wherein the closure rotating with respect to the container neck results in:

the plurality of frangible connections breaking; and subsequently, the top structure no longer being prevented from pivotal rotation with respect to the content enclosure as a result of the interface between the engaging structure and the thread of the container.

6. The container assembly of claim 5, the closure further comprising:

a J-band coupled to the tamper-evident band, wherein the J-band selectively interfaces against the container neck thereby causing the plurality of frangible connections to break when the closure is being opened.

7. The container assembly of claim 1, wherein the second annular wall of the top structure is configured to engage with the interior wall of the top structure to seal the aperture.

8. A closure comprising:

a first annular wall comprising a helical thread inwardly facing towards a longitudinal axis;

a top structure pivotally coupled to the first annular wall via a hinge, the top structure comprising a second annular wall and an engaging structure, the engaging structure restricts pivotal rotation of the top structure with respect to the first annular wall;

a content enclosure fixedly coupled to the first annular wall, the content enclosure comprising a third annular wall and an interior wall defining an aperture, the third annular wall of the content enclosure configured to interface with a container neck to form a fluid-tight seal, and the interior wall of the content enclosure interfacing with the top structure to form a fluid-tight seal, the top structure and the content enclosure configured to collectively form a fluid-tight seal with a container neck the closure is affixed to; and a tamper-evident band coupled to the first annular wall via a plurality of frangible connections, wherein the engaging structure restricts pivotal rotation of the top structure with respect to the first annular wall when the plurality of frangible connections are unbroken.

9. The closure of claim 8, the first annular wall and the third annular wall configured to engage opposing sides of the container neck.

10. The closure of claim 8, wherein the engaging structure restricts pivotal rotation of the top structure with respect to the first annular wall in part by interfacing against the helical thread of the container neck.

11. The closure of claim 10, the closure further comprising:

a J-band coupled to the tamper-evident band, wherein the J-band selectively interfaces against the container neck thereby causing the plurality of frangible connections to break.

12. The closure of claim 8, wherein the closure rotating with respect to the container neck results in:

the plurality of frangible connections breaking; and subsequently, the top structure no longer being prevented from pivotal rotation with respect to the content enclosure.

13. The closure of claim 12, the closure further comprising:

a J-band coupled to the tamper-evident band, wherein the J-band selectively interfaces against the container neck thereby causing the plurality of frangible connections to break when the closure is being opened.

14. The closure of claim 8, wherein the second annular wall of the top structure is configured to engage with the interior wall of the top structure to seal the aperture.

15. A closure comprising:

a first annular wall comprising a helical thread inwardly facing towards a longitudinal axis, the first annular wall centered about the longitudinal axis;

a top structure pivotally coupled to the first annular wall via a hinge, the top structure comprising a second annular wall and a securing tongue, the securing tongue protruding inwards towards the longitudinal axis and the hinge;

a content enclosure fixedly coupled to the first annular wall, the content enclosure comprising a lip, a third annular wall, and an interior wall defining an aperture, the lip extending outward from the third annular wall away from the longitudinal axis and the hinge, the lip configured to engage with the top structure to restrict pivotal rotation of the top structure with respect to the content enclosure, the third annular wall configured to interface with a container neck to form a fluid-tight seal, the interior wall of the content enclosure interfacing with the top structure to form a fluid-tight seal, the top structure and the content enclosure configured to collectively form a fluid-tight seal with a container neck the closure is affixed to; and a tamper-evident band coupled to the first annular wall via a plurality of frangible connections, wherein the securing tongue restricts pivotal rotation of the top structure with respect to the first annular wall when the plurality of frangible connections are unbroken.

16. The closure of claim 15, the first annular wall and the third annular wall configured to engage opposing sides of the container neck.

17. The closure of claim 15, the closure further comprising:

a J-band coupled to the tamper-evident band, wherein the J-band selectively interfaces against the container neck thereby causing the plurality of frangible connections to break.

18. The closure of claim 15, wherein the closure rotating with respect to the container neck results in:

the plurality of frangible connections breaking; and subsequently, the top structure no longer being prevented from pivotal rotation with respect to the content enclosure.

19. The closure of claim 18, the closure further comprising:

a J-band coupled to the tamper-evident band, wherein the J-band selectively interfaces against the container neck thereby causing the plurality of frangible connections to break when the closure is being opened.

20. The closure of claim 15, wherein the second annular wall of the top structure is configured to engage with the interior wall of the top structure to seal the aperture.

* * * * *